US006374420B2

(12) United States Patent
Jossi

(10) Patent No.: US 6,374,420 B2
(45) Date of Patent: Apr. 23, 2002

(54) FASTENER AND A TWO-PIECE CLOTHING COMPRISING IT

(76) Inventor: Ruedi Jossi, Zielwies, CH-8362, Balterswil (CH)

( * ) Notice: Subject to any disclaimer, the term of this patent is extended or adjusted under 35 U.S.C. 154(b) by 0 days.

(21) Appl. No.: 09/796,649

(22) Filed: Mar. 2, 2001

(30) Foreign Application Priority Data

Mar. 3, 2000 (DE) ..... 100 10 656

(51) Int. Cl.[7] ..... A41B 11/00
(52) U.S. Cl. ..... 2/239; 24/DIG. 29
(58) Field of Search ..... 2/239, 240, 241, 2/242; 24/706.9, 104, DIG. 29

(56) References Cited

U.S. PATENT DOCUMENTS

| | | | | | |
|---|---|---|---|---|---|
| 2,663,877 | A | * | 12/1953 | Bohman | 2/239 |
| 4,682,389 | A | | 7/1987 | Callender | |
| 5,038,413 | A | * | 8/1991 | Ursino | 2/239 |
| 5,321,855 | A | | 6/1994 | Ciuffo | |
| 5,357,660 | A | * | 10/1994 | Smith | 24/662 |
| 5,367,809 | A | * | 11/1994 | Ross | 40/668 |
| 5,579,541 | A | * | 12/1996 | Christy et al. | 2/239 |
| 5,740,558 | A | * | 4/1998 | Messman | 2/239 |
| 5,918,318 | A | * | 7/1999 | Jones | 2/239 |
| 5,970,524 | A | * | 10/1999 | Becker et al. | 2/239 |
| 5,974,590 | A | * | 11/1999 | Stubbs | 2/239 |
| 6,032,294 | A | * | 3/2000 | Dean | 2/239 |
| 6,067,659 | A | * | 5/2000 | Reichle | 2/239 |
| 6,092,241 | A | * | 7/2000 | Bellet | 2/239 |
| 6,185,751 | B1 | * | 2/2001 | Mason | 2/239 |
| 6,237,158 | B1 | * | 5/2001 | Barbara | 2/239 |

FOREIGN PATENT DOCUMENTS

| | | |
|---|---|---|
| DE | 198 35 471 | 2/2000 |
| DE | 299 16 773 | 2/2000 |
| GB | 2 327 856 | 2/1999 |
| WO | WO 96/26656 | 9/1996 |
| WO | WO 97/19216 | 5/1997 |
| WO | WO 97/38596 | 10/1997 |

* cited by examiner

*Primary Examiner*—John J. Calvert
*Assistant Examiner*—Alissa L. Hoey
(74) *Attorney, Agent, or Firm*—Burns, Doane, Swecker & Mathis, LLP

(57) ABSTRACT

A fastener for fastening a pair of clothing together, comprises two complementary securing elements to be secured to a said pair of clothing. One fastening element has at least one fastening projection in a center region, while the other one has at least one opening for receiving the fastening projection. The center region is connected to at least one elongated securing surface which protrudes away from it. Each securing surface includes at least one strip of textile material which extends beyond the respective center region. The strip of textile material has a cut-out for allowing the fastening projection(s) to penetrate.

21 Claims, 2 Drawing Sheets

FASTENER AND A TWO-PIECE CLOTHING COMPRISING IT

FIELD OF THE INVENTION

This invention relates to a fastener for fastening a matched pair of clothing together, such as shoes, socks, gloves, a two-piece swimming costume or the like. In correspondence with the two pieces of the pair of clothing, the fastener comprises a first securing part to be secured to one piece of clothing, and a second securing part to be secured to the other piece of clothing.

The first securing part includes a first fastening element which is provided in a center region of the first securing part and has at least one fastening projection. The second securing part includes a second fastening element which is provided in a center region of the second securing part and has at least one opening for receiving the respective fastening projection of the first fastening element so as to interconnect the first and second securing parts and fasten them to one another.

There are also first and second securing surfaces to be connected each to one piece of clothing, and which protrude away from the respective center regions of the first and second securing parts. Each one of the securing surfaces includes at least one strip of textile material extending beyond the respective center region of said first and second securing means.

The invention relates also to a two-piece clothing which comprises a fastener of the type described.

BACKGROUND OF THE INVENTION

Various constructions of this type of releasable fasteners have already been suggested. They are used to prevent a situation where one piece is lost, particularly when washing the two-piece clothing, so that the remaining part can no longer be used. For example, the documents PCT No. WO 96/26656 and U.S. Pat. No. 5,321,855, both of which are hereby incorporated by reference in their entirety, show strips of Velcro fasteners which may be connected to a relatively large area of a sock so as to adhere to it in a relatively good way, but tend to felt when being washed. Practically, it is then hardly possible to wash the clothing provided with such a fastener together with other clothing, because the risk exists that textile pieces which are washed in common become mutually felted and cannot be separated afterwards from one another. In addition, Velcro fasteners are relatively hard and inflexible, thus causing a disagreeable feeling when wearing clothing provided with them.

Document PCT No. WO 97/19216, hereby incorporated by reference in its entirety, shows a different type of a fastener in which each individual component is in two-part form itself. The two sub-parts are then interconnected and secured to the piece of clothing or sock by a single pin penetrating the sock from its interior to its exterior. One disadvantage of such a fastener is that the whole fastener comprises four parts which is expensive and is relatively thick. This can cause a disagreeable feeling of pressure when wearing clothing with such a fastener. Moreover, the fastener is connected to the sock by a relatively thin pin only which penetrates the sock. In this way, the region of the sock to which the fastener is connected is subjected to considerable stress due to movements in a washing machine, resulting in a drawn and shabby spot around the fastener.

These particularities and difficulties are clearly pointed out in document PCT No. WO 97/38596, hereby incorporated by reference in its entirety, which suggests to connect such a fastener only to socks or stockings of a certain minimum mesh density. While part of the fastener components shown in this PCT No. WO 97/38596 are based on the same principle as applied also in the above-mentioned PCT No. WO 97/19216, therefore involving the same drawbacks, it is also suggested to sew some ribbon provided with a part of a fastener onto each sock. Of course, this is most problematic both when wearing the sock and when washing it. Another suggestion uses a similar design as used for press fasteners, i.e. a dish-like outer portion surrounding a center portion where the outer portion is provided with sewing holes. Such press fasteners, however, can only have a limited size, and the dish-like outer portion can have a small diameter. If the outer portion were too large, it would constitute an inflexible, hard and pressing part on the piece of clothing. Ordinarily it will be relative small, which results in that fastening stress is concentrated to a relative small portion of the clothing which, in turn, has easily the consequence of being torn off, or the clothing is locally elongated or pulled out, especially if the clothing is of a knitted fabric.

A strip of fabric for sewing the fastener onto a sock is also disclosed in U.S. Pat. No. 5,038,413, hereby incorporated by reference in its entirety. However, there is no suggestion how to solve the problem of connecting both the strip of fabric and the center portion of the respective fastener component to the pieces of clothing. Normally, it would require two individual procedures of interconnecting them, for example, by sewing the respective fastener component to the textile material and then to sew the textile strip onto the respective sock. This, of course, is expensive and arduous.

SUMMARY OF THE INVENTION

Therefore, it is an object of the present invention to form a fastener of the type described in such a way that it can be connected to the respective piece of clothing at less expenses and in a less arduous manner.

This object is achieved according to the invention where a fastener is used which comprises at least one fastening projection (as it is the case with one component of a press fastener, but could, in principle, also be embodied with several projections), and that the textile material has a cut-out which allows the at least one projection to penetrate. In this way, the respective fastener component is retained by the textile material which is the only part which needs a connection to the piece of clothing. The projection of one fastener component projects out of the cut-off and is inserted into the opening of the other fastener component through a corresponding cut-out of the textile material sewed to the other piece of clothing.

However, if according to the invention at least one projection is provided, this center region is better retained within the cut-out of the textile material. The elongated securing surface(s) increase the securing area of the fastener to the respective piece of clothing so that any stress which may act onto the place of connection will exert less force to it.

According to a second aspect of the present invention, a two-piece clothing has the above-mentioned fastener sewed to it so that both the textile material and the center region of the fastener are sewed onto the piece of clothing by a single sewed seam.

BRIEF DESCRIPTION OF THE DRAWINGS

Further details of the present invention will become apparent from the following description of embodiments schematically illustrated in the drawings in which:

In FIG. 1, two matching socks 1*a,* 1*b* are represented as a preferred example of a two-piece clothing. As already mentioned at the outset, the invention is not restricted to socks, but can be applied to any two-piece clothing, such as gloves, bikinis and so on. Socks, in particular, are generally made of a more or less fine knitted fabric. Therefore, it is important for securing a fastener according to the invention, as described later with reference to FIGS. 2 to 7, so that stress load per surface area which is caused by securing the fastener to a sock is very low. It is only in this way that it is possible to avoid those limitations which were inherent to the known fasteners according to WO 97/38596 with respect to the mesh density.

Figure 1:
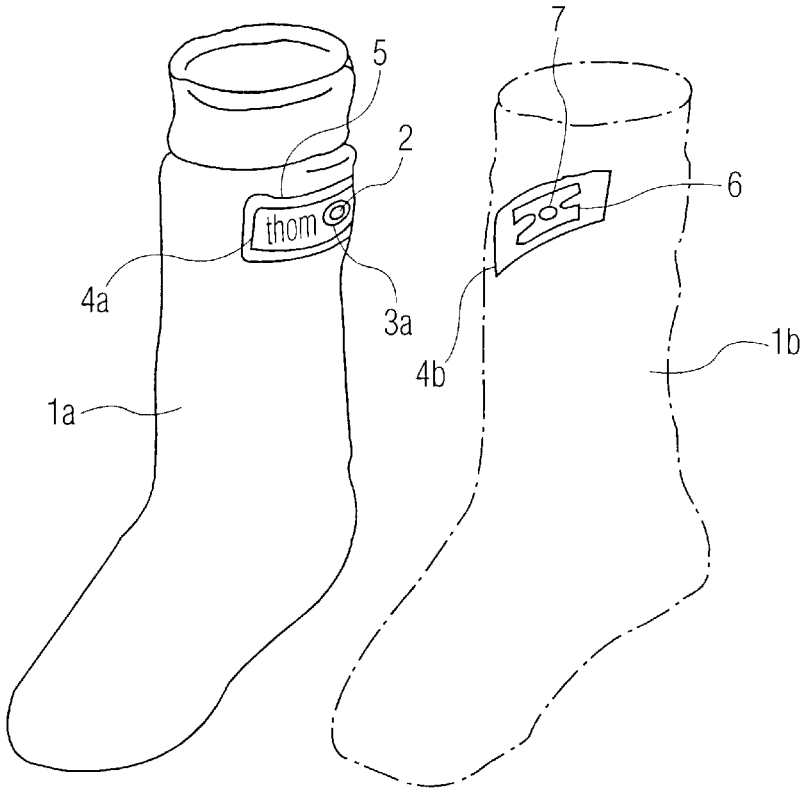
FIG. 1 shows a pair of socks according to the invention.

As may be seen from FIG. 1, a press fastener projection 2 (it could also be a hook to be hooked into an eye instead, although this is less preferred) projects through a cut-out 3*a* of a textile label 4*a* which surrounds it. Such a label 4*a* can be secured to a sock 1 over a relative large area along a seam line 5, particularly by sewing. In this way, the stress load exerted to the socks 1*a,* 1*b* when interconnecting or fastening the two parts of the fastener, i.e. the press fastener projection 2 and the securing element 6 which has an opening 7 for receiving the projection 2, is distributed over a relatively large area, thus burdening the respective clothing 1*a,* 1*b* to a relative low extent. The securing element 6 too is covered by a label 4*b* which can be sewed to the sock 1*b* (it could, theoretically, also be welded onto it, but flexibility of a textile label is better retained by sewing) and has a cut-out corresponding to cut-out 3*a*, but not shown in FIG. 4, which gives the opening 7 free for penetration of the projection 2. Using a textile material, as formed by the textile labels 4*a*, 4*b*, has the additional advantage that the fastener according to the invention does not press onto the leg of a person who puts the socks 1*a*, 1*b* on, thereby causing a disagreeable feeling.

Figure 2:
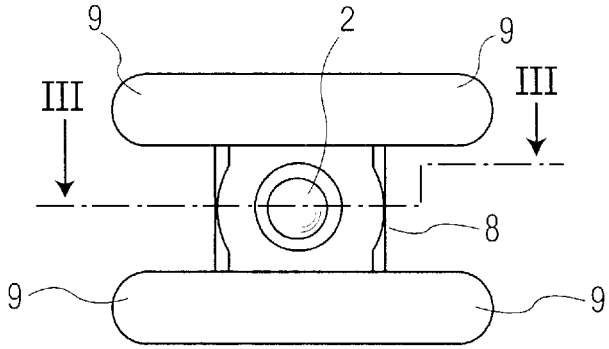
FIG. 2 a planar view of a press fastener part of a fastener unit which supports a fastening projection according to the present invention.
Figure 3:
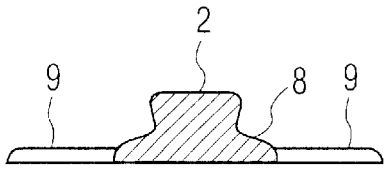
FIG. 3 illustrates a cross-section according line III—III of FIG. 2.

FIG. 2 illustrates a plan view of the press fastener projection 2 at an enlarged scale as compared with FIG. 1. The press fastener projection 2 projects out of the plane of projection from a flat central portion 8 which, in this embodiment, is tetragonal but may have any shape desired. Integrally formed with the central portion 8 are four elongated protrusions 9 which extend away from the central portion 8. Two of these protrusions on either side of the central portion 8 form together an aligned securing surface. This securing surface, preferably also the central portion 8, consist suitably of a flexible plastic material which snugly adapts itself to the roundings of the body, on the one hand, and has not too much resistance to a needle when being sewn to the respective sock 1*a* or 1*b* together with the textile label 4, as is preferred, although the plastic protrusions 9 are advantageous in themselves as they prevent the fastening element's center portion 8 or that of the securing element 6 with the opening 7 from falling through the cut-out 7 (being additionally interconnected by sewing or not). The length of the protrusions can be chosen in such a manner that they can be secured to the sock 1*a* (FIG. 1) either by welding or gluing (less preferred) or by at least one seam, optionally more than one, which either overlaps or penetrates them. As shown in FIG. 3, the protrusions 9 may be relative thin in comparison with the central portion 8 in order to maintain their flexibility, while the central portion 8 remains stable enough to allow fastening (pressing the projection 2 into the opening 7).

As has been mentioned above with reference to FIG. 1, strips 4*a*, 4*b* of a textile material are provided for securing the respective part 2 or 6 of the fastener 2+6 according to the invention. It is not necessary that such textile material extends beyond both sides of the center region 8, because it could project only at one side, while the other side may be secured by binding stitches binding the protrusions 9, as described above. Alternatively, the protrusions 9 are formed as clamps (which is preferred) and are clamped to the respective sock, while the other side of the center region is secured by sewing the textile (half) label as mentioned above.

Figure 4:
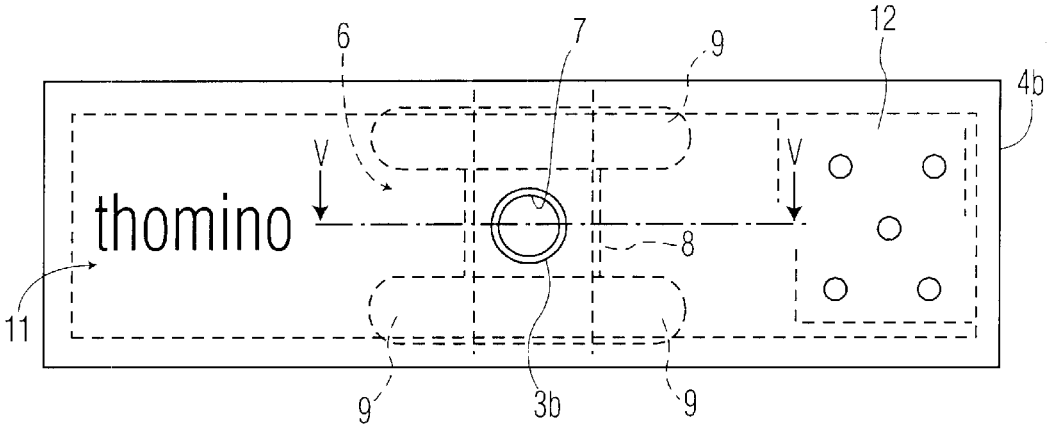
FIG. 4 represents a securing element of a fastener under textile material according to the present invention, the opening of which receives the press fastener projection of FIG. 2, the textile material forming an elongated securing surface which protrudes away on both sides from the center region of the securing element.
Figure 5:
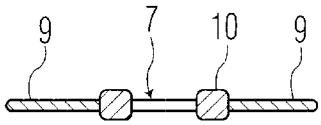
FIG. 5 shows a cross-section along the line V—V of FIG. 4 through the securing element with the opening alone.

In FIG. 4, which shows the securing element 6 with the opening 7 in dotted lines, the cut-out 3*b* may be seen which surrounds the opening 7 of the securing element 6. In this embodiment, the seam 5 is provided at a level where it passes through the upper and lower protrusions 9 (with reference to FIG. 4), thus connecting them with the textile label concurrently with securing the whole unit to the sock. This is preferred in comparison with other possibilities, as mentioned above and later, of welding or gluing, because any known sewing machine can easily effect sewing, which is suitable for securing the label to the respective clothing anyway, without previously perforating the protrusions so that at the same time and in a single procedure the fastener component 2 or 6 is also secured to the textile label. Such sewing is facilitated, in addition, by providing a pair of protrusions 9 aligned to form a continuous surface in common. From FIG. 5, it may be seen, that the edge 10 of the opening 7 is preferably reinforced in the manner of a surrounding bead in order to ensure safe engagement of the press fastener projection 2 (FIGS. 2, 3). Sewing is the most preferred way of securing the fastener to the piece of clothing, because it maintains flexibility of the material.

When using textile material, there is, however, another alternative to ensure the correct position and the alignment of the opening 7 and the cut-out 3*b* by gluing, using any adhesive known, or by welding the textile label 4*b* to the fastener elements 6. To this end, the two parts 4*b* and 6 consist preferably of a weldable plastic material. Welding (e.g. ultra-sound welding or heat sealing) will be suitable at least around the cut-out 3*b*, but a larger area is preferred to ensure a better adhesion. For example, the entire center region 8 may be used as a welding zone, but in some cases also the elongated protrusions 9 in order to use these securing elements indirectly also for securing it to the respective sock via the textile label 4*b*. As mentioned above, however, the first mentioned alternative of sewing is preferred.

The various advantages of using textile material as a securing surface protruding from the center region 8 has already been mentioned above in view of securing to the respective sock through the seam line 5. A further advantage resides in that this flexible securing element of a relative large area can be used for giving information, such as the washing temperature recommended, the washing agent or about the material of the socks. In the present case, as shown in FIG. 4, the textile label 4*b* has a first information field 11 to show a trademark ("thomino"), and a second information field 12 which has two points in the manner of a domino which corresponds to the respective numeral. In this way, matching socks 1*a,* 1*b* (FIG. 1) can be marked, for example, by the same numeral (or the same number of points). Of course, the invention is not restricted to this arrangement of indicating matching socks in the field 12, for threads of a certain color or color combination could be stitched in or an indication of the name of the user, and so on.

Figure 6:
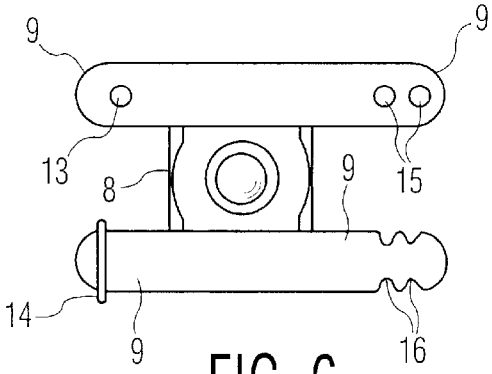
FIG. 6 represents modifications of the embodiment shown in FIG. 2.

FIG. 6 shows how protrusions 9 can be shaped, especially when using them without a textile label so that the components of a fastener according to the invention have to be sewed to the respective sock directly via these protrusions. To this end, one protrusion 9 may comprise an eye-shaped hole 13 for penetration of stitches, or even several holes, as is preferred. The elongated shape of the protrusions 9 enables easily to provide a plurality of stitches over their length.

A further possibility is shown in FIG. 6 at left, below, in the form of a rib 14 to prevent the thread of a seam from sliding over the end of the protrusion 9. Such an embodiment is, however, less preferred, because a rib will, in general, make the protrusion more rigid. The same applies to burls 15 that project from the securing surface of the of the respective protrusion 9 (top of FIG. 6 at right). Better are recesses 16 shown at right, below, which enable engagement of a seam without affecting the flexibility of a protrusion. This latter advantage will also exist if the protrusion 9 has a series of holes 13.

Figure 7:
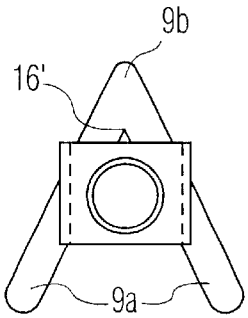
FIG. 7 a further modified embodiment having differing protrusions which extend from the center region of the fastener.

It has been mentioned above that the fastener according to the present invention may be used as a bearer of an information, such as a trademark. FIG. 7 illustrates that the invention is not restricted to having four (or, since forming together a single securing surface: two) protrusions. Moreover, the protrusions can form a letter, as in FIG. 4, (in this case an "A") which either provides an indication of the size of the socks or represents the initial or the trademark of the producer firm. In this manner, the protrusions 9*a,* 9*b* constitute themselves an information field connected to the fastener. In the embodiment shown in FIG. 7 by way of example, the upper protrusion 9*b* is triangular and has a hole 16 which doe not only form the opening of the letter "A", but can also be used for stitching the fastener onto the respective clothing. The line of this triangle continues with two lower protrusions 9*a.* This shows that the invention is not restricted to a certain number of protrusions or strips, although it will be advantageous for the reasons of flexibility and facilitation of manufacture if the number of protrusions or strips is limited, particularly to six in maximum or eight in maximum, the two or four, as illustrated, being preferred.

In addition, the above description shows that various types of fasteners, apart from press fasteners (which are preferred), are possible. Likewise, different shapes of the center region 8 and of the elongated protrusions can also be conceived.

It will be appreciated by those skilled in the art that the present invention can be embodied in other specific forms without departing from the spirit or essential charateristics thereof. The presently disclosed embodiments are therefore considered in all respects to be illustrative and not restrictive. The scope of the invention is indicated by the appended claims rather than the foregoing description and all changes that come within the meaning and range and equivalence thereof are intended to be embraced therein.

What is claimed is:

1. A fastener for fastening a pair of clothing together, comprising:

first securing means to be secured to one of said pair of clothing;

a first fastening element provided in a center region of said first securing means and having at least one fastening projection formed on a flat central portion of said first fastening element;

second securing means to be secured to the other one piece of said pair of clothing; and a second fastening element provided in a center region of said second securing means and having at least one opening for receiving said at least one fastening projection of said first fastening element, wherein first and second securing means each form at least one elongated securing surface which protrudes away from said center regions of said first and second securing means, each securing means including:

at least one strip of textile material extending beyond the respective center regions of said first and second securing means, said strip of textile material having a cut-out for allowing said at least one fastening projection to penetrate, and said flat central portion being larger than said cut-out of first securing means.

2. Fastener as claimed in claim 1, wherein at least one securing surface comprises at least one flat protrusion of one of said center regions.

3. Fastener as claimed in claim 2, wherein said flat protrusion is of plastic material.

4. Fastener as claimed in claim 2, wherein at least one securing surface comprises at least two flat protrusions.

5. A fastener for fastening a pair of clothing together, comprising:

first securing means to be secured to one piece of said pair of clothing;

a first fastening element provided in a center region of said first securing means and having at least one fastening projection;

second securing means to be secured to the other one piece of said pair of clothing; and a second fastening element provided in a center region of said second securing means and having at least one opening for receiving said at least one fastening projection of said first fastening element, wherein first and second securing means each form at least one elongated securing surface which protrudes away from said center regions of said first and second securing means, wherein at least one securing surface comprises two pairs of flat protrusions of one of said center regions extending in different directions, each securing means inluding:

at least one strip of textile material extending beyond the respective center regions of said first and second securing means, said strip of textile material having a cut-out for allowing said at least one fastening projection to penetrate.

6. Fastener as claimed in claim 4, wherein said two flat protrusions are aligned to form a continuous surface.

7. A fastener for fastening a pair of clothing together, comprising:

first securing means to be secured to one piece of said pair of clothing;

a first fastening element provided in a center region of said first securing means and having at least one fastening projection;

second securing means to be secured to the other one piece of said pair of clothing; and a second fastening element provided in a center region of said second securing means and having at least one opening for receiving said at least one fastening projection of said first fastening element, wherein:

first and second securing means each form at least one elongated securing surface which protrudes away from said center regions of said first and second securing means, each securing means including at least one strip of textile material extending beyond the respective center regions of said first and second securing means, said strip of textile material having a cut-out for allowing said at least one fastening projection to penetrate, at least one securing surface comprises at least two flat protrusions of one of said center regions, said two flat protrusions are integral, at least one securing surface including said flat protrusions being secured to said textile material, and said textile material is longer than said flat protrusions.

8. A fastener for fastening a pair of clothing together, comprising:

first securing means to be secured to one piece of said pair of clothing;

a first fastening element provided in a center region of said first securing means and having at least one fastening projection;

second securing means to be secured to the other one piece of said pair of clothing; and a second fastening element provided in a center region of said second securing means and having at least one opening for receiving said at least one fastening projection of said first fastening element, wherein:

first and second securing means each form at least one elongated securing surface which protrudes away from said center regions of said first and second securing means, each securing means including at least one strip of textile material extending beyond the respective center regions of said first and second securing means, said strip of textile material having a cut-out for allowing said at least one fastening projection to penetrate, at least one securing surface comprises at least two flat protrusions of one of said center regions, said two flat protrusions are integral with one of said center regions, at least one securing surface including said flat protrusions being secured to said textile material, the center region being thicker than said protrusions, and said textile material is longer than said flat protrusions.

9. Fastener as claimed in claim 1, wherein at least one center region is of plastic material.

10. Fastener as claimed in claim 9, wherein at least one said textile material comprises a weldable plastic material, said plastic center region and said textile material being welded together so as to form a center region from which said textile material extends.

11. Fastener as claimed in claim 1, wherein said projection of said first fastening means and said opening of said second fastening means form two parts of a press fastener.

12. Fastener as claimed in claim 1, further comprising at least one information frame.

13. Fastener as claimed in claim 12, wherein said at least one information frame is on at least one said textile material.

14. Fastener as claimed in claim 12, wherein said at least one information frame includes a trademark sign.

15. Fastener as claimed in claim 12, wherein said at least one information frame includes an indication to an assignment of said pair of clothes.

16. A two-piece clothing for a pair of extreme human limbs, comprising:

a first piece of clothing;

a second piece of clothing, said first and second pieces of clothing being matched;

first securing means being assigned and secured to said first piece of clothing and including a first fastening element provided in a center region of said first securing means and having at least one fastening projection formed on a flat central portion of said first fastening element; and second securing means being assigned and secured to said second piece of clothing and including a second fastening element provided in a center region of said second securing means and having at least one opening for receiving said at least one fastening projection of said first fastening element, wherein first and second securing means each form at least one elongated securing surface which protrudes away from said center regions of said first and second securing means, each securing means including:

at least one strip of textile material extending beyond the respective center region of said first and second securing means, said strip of textile material having a cut-out for allowing said at least one fastening projection to penetrate, wherein each strip of textile material is connected to a respective piece of clothing by a sewed seam such that said seam directly connects both said textile material and the respective securing means to the assigned piece of clothing, and wherein said flat central portion is larger than said cut-out of first securing means.

17. Clothing as claimed in claim 16, wherein said first and second pieces of clothing are pieces of foot clothing.

18. Clothing as claimed in claim 17, wherein said first and second pieces of clothing form a pair of socks.

19. Clothing as claimed in claim 16, wherein said sewed seam penetrates the textile material, the respective securing means and the assigned piece of clothing.

20. Clothing as claimed in claim 19, wherein said securing surface comprise at least one prolongation of said center region, said prolongation being situated between the assigned piece of clothing and said textile material.

21. Clothing as claimed in claim 20, wherein said sewed seam penetrates the textile material, the respective securing surface and the assigned piece of clothing.

* * * * *